US006817144B1

(12) United States Patent
Tavivian

(10) Patent No.: US 6,817,144 B1
(45) Date of Patent: Nov. 16, 2004

(54) METHOD FOR FORMING AN ENCLOSURE

(75) Inventor: Aharon Tavivian, Omer (IL)

(73) Assignee: MTD Industries Ltd., Beer Sheva (IL)

( * ) Notice: Subject to any disclaimer, the term of this patent is extended or adjusted under 35 U.S.C. 154(b) by 0 days.

(21) Appl. No.: 10/148,437

(22) PCT Filed: Dec. 1, 1999

(86) PCT No.: PCT/IL99/00647

§ 371 (c)(1),
(2), (4) Date: May 30, 2002

(87) PCT Pub. No.: WO01/39647

PCT Pub. Date: Jun. 7, 2001

(51) Int. Cl.[7] ..... A47K 3/30; E06B 3/06

(52) U.S. Cl. ..... 52/35; 52/204.599; 52/208; 52/717.03; 52/800.15; 52/741.1; 4/607; 4/614; 49/413

(58) Field of Search ..... 52/35, 208, 204.51, 52/204.595, 204.599, 716.1, 717.02, 717.03, 800.15, 741.1, 204.597, 741.15; 49/413, 490.1, 484.1, 498.1; 4/607, 613–614

(56) References Cited

U.S. PATENT DOCUMENTS 2,609,071 A * 9/1952 Morgann et al. ..... 52/204.597
2,679,915 A * 6/1954 Clingman ..... 52/214
3,430,394 A * 3/1969 Johnston ..... 52/127.1
4,611,436 A * 9/1986 Williams ..... 49/425
4,671,026 A * 6/1987 Wissinger ..... 52/35
4,720,876 A * 1/1988 Tomei et al. ..... 4/614
4,903,433 A * 2/1990 Baus ..... 49/40
5,657,581 A * 8/1997 Husting ..... 49/409
5,694,722 A * 12/1997 Husting et al. ..... 52/35
6,122,883 A * 9/2000 Braun ..... 52/717.01
6,435,257 B2 * 8/2002 Simkovich ..... 164/122.1

FOREIGN PATENT DOCUMENTS

EP 504602 * 2/1992

* cited by examiner

*Primary Examiner*—Winnie Yip
(74) *Attorney, Agent, or Firm*—Sughrue Mion, PLLC

(57) ABSTRACT

Method for forming an enclosure of the type having a plurality of enclosure panels and at least one door, comprising: providing a first flexible profile element (12) web (14) dividing said element into an upper channel (16) bounded by a pair of spaced-apart, upwardly extending arms (18, 20) of unequal height, and a lower channel (22) bounded by a pair of spaced-apart downwardly extending legs (24, 26) being provided with an inwardly directed flange (28) for receiving and retaining at least one rigidifying metallic strip element (30), said upper arms (18, 20), having inwardly directed interfacing portions (32) for receiving and retaining an enclosure panel (34) inserting a metallic strip (30) into said lower channel (22) formed in said flexible profile element (12) to form a rigid composite base element; and inserting a plurality of enclosure panels in said upper channel to form the walls.

13 Claims, 4 Drawing Sheets

METHOD FOR FORMING AN ENCLOSURE

FIELD OF THE INVENTION

The present invention relates to a perimeter base for an enclosure. More particularly, the invention provides a rigidized perimeter base which may serve as a template for the construction of the enclosure panel walls.

BACKGROUND

Shower enclosures, often called stalls or cabinets, are in widespread use. Many such enclosures are intended for use in conjunction with one or two existing tiled walls, and therefore provide only the remaining two or three wall panels.

A four-sided enclosure has the advantage that it can be positioned anywhere drainage can be provided, and requires no sealing to existing walls. It is therefore more suitable for erection by the do-it-yourself householder. Shower enclosures are expected to be of pleasing external appearance, and it is most important that water does not leak to its outside.

In U.S. Pat. No. 4,152,789 Heath discloses a three-sided shower stall rigidized by handrails and an external outer brace.

Brown in U.S. Pat. No. 4,215,444 discloses a shower stall which confines water therein by means of an antechamber disposed at right-angles to the showering area. The conventional door is thus eliminated, but extra space, which may be unavailable, is required.

A shower stall threshold structure is described by Presti in U.S. Pat. No. 4,551,870. The structure requires casting mortar between spacer is a formidable task for the average do-it-yourself handyman.

Powers discloses a method and apparatus for forming a shower base in U.S. Pat. No. 5,092,002. The base includes a floor, a drain, and a low water-retaining wall. The water retaining wall includes an inclined insert formed of PVC. No wall panels are included, so the shower base is probably intended for use in combination with a shower curtain.

Shower stalls are not necessarily of rectangular or square shape. Very attractive enclosures may be constructed using curved or angled walls. A further use of such shapes is to make use of an irregular area available. Known methods of erecting irregular-shaped shower enclosures are labor intensive.

The present inventors have disclosed shower stalls in Israel Patents nos. 117 154 and 122 000. The later specification in FIG. 5 shows a shower having curved walls. The present invention is of particular utility for the construction of enclosures of this type.

SUMMARY OF THE INVENTION

It is therefore one of the objects of the present invention to obviate the disadvantages of prior art methods of shower stall construction and to provide a method which saves time during erection and provides a leak-proof enclosure.

It is a further object of the present invention to provide a base profile construction adapted for such purpose.

The present invention achieves the above objects by providing a method for forming an enclosure of the type having a plurality of enclosure panels and at least one door, comprising:

a) providing a first flexible profile element, said profile element having two side walls connected by an axially-extending web dividing said element into an upper channel bounded by a pair of spaced-apart, upwardly extending arms of unequal height, and a lower channel bounded by a pair of spaced-apart downwardly extending legs, each of said legs being provided with an inwardly directed flange for receiving and retaining at least one rigidifying second metallic strip element in said lower channel, said upper arms having inwardly directed interfacing portions for receiving and retaining an enclosure panel inserted therein;

b) providing a metallic strip of a length and configuration commensurate with at least a portion of the walls of the enclosure to be formed;

c) inserting said metallic strip into said lower channel formed in said flexible profile element to form a rigid composite base element of a length and configuration commensurate with the enclosure panels and doors of the enclosure to be formed; and d) inserting a plurality of enclosure panels in said upper channel between said inwardly directed interfacing portions thereof to form the walls of said enclosure, while further rigidifying said first profile and creating a waterproof seal between said rigid composite base element and a smooth floor surface on which it is erected.

In a preferred embodiment of the present invention there is provided a method further comprising positioning a channel filling member along a segment of said upper channel, said member being provided with an upper inclined surface sloping away from a higher external upwardly extending arm of said channel to a lower internal upwardly extending arm of said channel, to form a water-proof seal with the top of said external upwardly extending arm segment.

In a most preferred embodiment of the present invention there is provided a rigid composite base unit for use in the above method, said unit comprising:

a) a first flexible profile element, said profile element having two side walls connected by an axially-extending web dividing said element into an upper channel bounded by a pair of spaced-apart, upwardly extending arms of unequal height, and a lower channel bounded by a pair of spaced-apart downwardly extending legs, each of said legs being provided with an inwardly directed flange for receiving and retaining at least one rigidifying second metallic strip element in said lower channel, said upper arms having inwardly directed interfacing portions for receiving and retaining an enclosure panel, inserted therein; and b) a metallic strip of a length and configuration commensurate with at least a portion of the wails of the enclosure to be formed, the arrangement being such that upon insertion of said metallic strip into said lower channel, there is formed a rigid composite base element of a length and configuration commensurate with the enclosure panels and doors of the enclosure to be formed.

In especially preferred embodiments of the present invention said rigid composite base unit is provided in combination with a plurality of enclosure panels inserted in said upper channel for exerting vertical forces on said base unit to rigidify the same and creating a water-proof seal between said enclosure panels, said rigid composite base element and a smooth floor surface on which it is erected.

Yet further embodiments of the invention will be described hereinafter.

It will thus be realized that the novel shower enclosure base profile of the present invention serves to act as a template in marking the floor and in preparing the panels for insertion therein. The metal insert rigidities the plastic profile. The lower edge of the shower enclosure doors are above the upper edge of the base profile, which therefore runs continuously, including under the doors without preventing their movement. Continuity of the base profile, even around sharp comers, facilitates leak prevention.

Insertion of the metal strip into the lower part of the flexible profile is readily achieved by squeezing together the upper portion of the profile. The flexible profile can then be locked to prevent inadvertent release of the metal profile by inserting a filling member along a segment of the upper channel, as will be explained.

The base profile can be further stabilized by use of a flexible, and preferably adhesive seal element on a lower face arranged to contact the floor surface on which said base unit rests. Thus leakage under the base profile is prevented.

The invention will now be described in connection with certain preferred embodiments with reference to the following illustrative figures so that it may be more fully understood.

BRIEF DESCRIPTION OF THE DRAWINGS

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings.

DETAIL DESCRIPTION OF THE DRAWINGS

Figure 1:
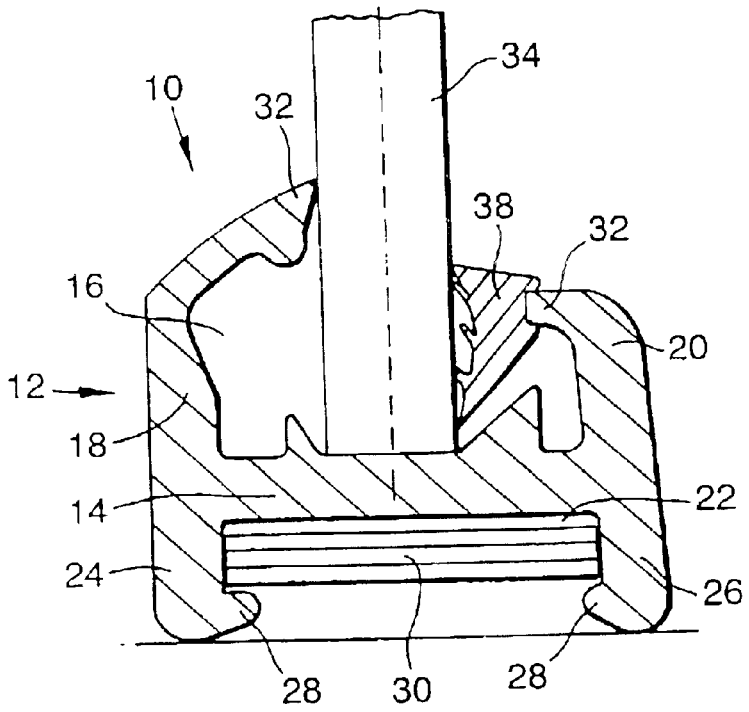
FIG. 1 is an end elevation of a preferred embodiment of a rigid composite base unit according to the invention.

There is seen in FIG. 1 a rigid composite base unit 10 for use in forming an enclosure, typically a shower stall.

A first flexible profile element 12 has two side walls 18-24, 20-26 connected by an axially-extending web 14. The element 12 is suitably made of polyvinyl chloride (PVC) or of polypropylene.

The web 14 divides the element 12 into an upper channel 16 bounded by a pair of spaced-apart, upwardly extending arms 18, 20 of unequal height, and a lower channel 22 bounded by a pair of spaced-apart downwardly extending legs 24,26. Each lower leg 24,26 is provided with an inwardly directed flange 28 for receiving and retaining a rigidifying second metallic strip element 30 in the lower channel 22.

Suitably the metallic strip element 30 is made of aluminium.

The upper arms 18,20 have inwardly directed interfacing portions 32 for receiving and retaining an enclosure panel 34, inserted therein.

The metallic strip 30 has a length and configuration commensurate with at least a portion of the walls of the enclosure to be formed. The arrangement is such that upon insertion of the metallic strip 30 into lower channel 22, there is formed a rigid composite base element 10 of a length and configuration commensurate with the enclosure panels 34 and doors 36 seen in FIG. 3 of the enclosure to be formed.

Advantageously the metallic strip 30 is of a length and configuration commensurate with the base and the enclosure to be formed, being a single strip or alternatively, a plurality of metallic strip elements 30 can be sequentially inserted into lower channel 22, wherein said strips are arcuate in shape to form elegantly-shaped enclosures, as illustrated and discussed with reference to FIGS. 11 and 12 hereinafter.

Said metallic strip 30, when non-linear and/or of irregular shape, can be prepared using computerized metal-cutting technology, including computer-controlled laser-cutting implements.

The FIG. shows that the panel 34 has been sealed in the upper channel 16 by inserting a wedge-like element 38 between an inner surface of the panel 34 and an upwardly extending arm 20. Element 38 is suitably made of an elastomer. Splash water thus drains off the panel 34, flows across the top of the wedge-like element 38, over the lower arm 20, to enter a drain, not shown.

With reference to the rest of the figures, similar reference numerals have been used to identify similar parts.

Figure 2:
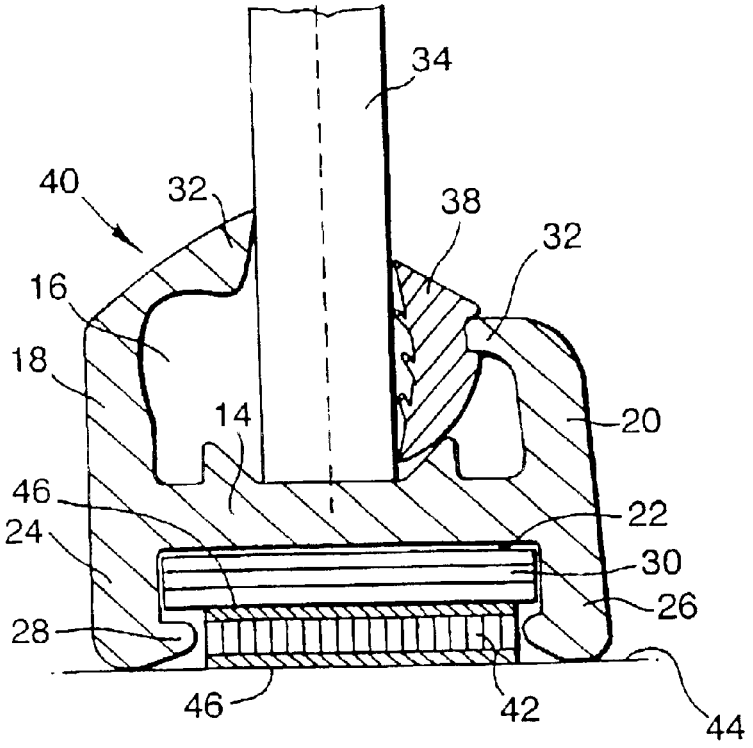
FIG. 2 is an end elevation of a second embodiment provided with a flexible seal element.

Referring now to FIG. 2, there is seen a similar rigid composite base unit 40 wherein the metallic strip 30 is provided on a lower face with a flexible seal element 42 configured to contact the floor surface 44 on which said base unit 40 rests. Seal element 42 is suitably made of a polyester strip coated on both sides with an adhesive 46.

Figure 3:
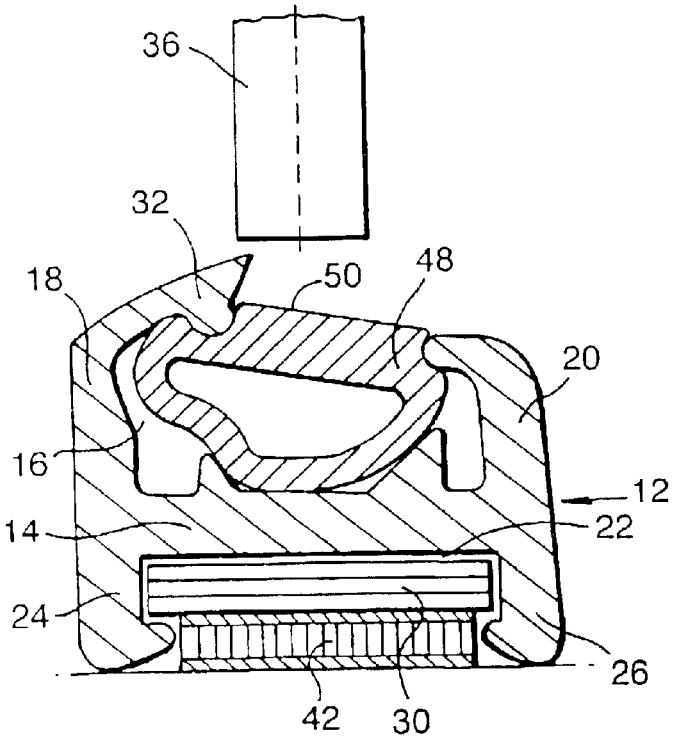
FIG. 3 is an end elevation of a flexible profile element under a door of a shower enclosure.
Figure 5:
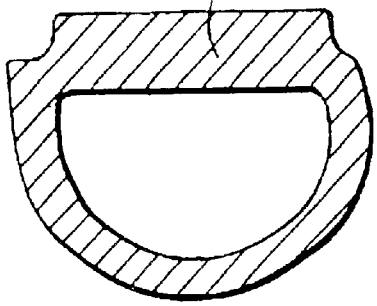
FIG. 5 is an end view of a flexible element used in the embodiment shown in FIG. 3.

FIG. 3 illustrates a section of the first flexible profile element 12 under a door 36 of the shower enclosure. A flexible channel filling member 48 is inserted along a segment of the upper channel 16. Before insertion the member 48 has a cross-sectional shape which is substantially semi-circular as seen in FIG. 5. The member 48 takes up the shape shown after insertion. The member 48 then has an upper inclined surface 50 sloping away from a higher external upwardly extending arm 18 of the channel 16 to a lower internal upwardly extending arm 20 thereof. Thereby a water-proof seal is formed with the top of the external upwardly extending arm 20.

The member 48 also serves to impede possible inward movement of upper arms 18,20 and thus to prevent inadvertent release of the metallic strip 30 from lower channel 22.

Figure 4:
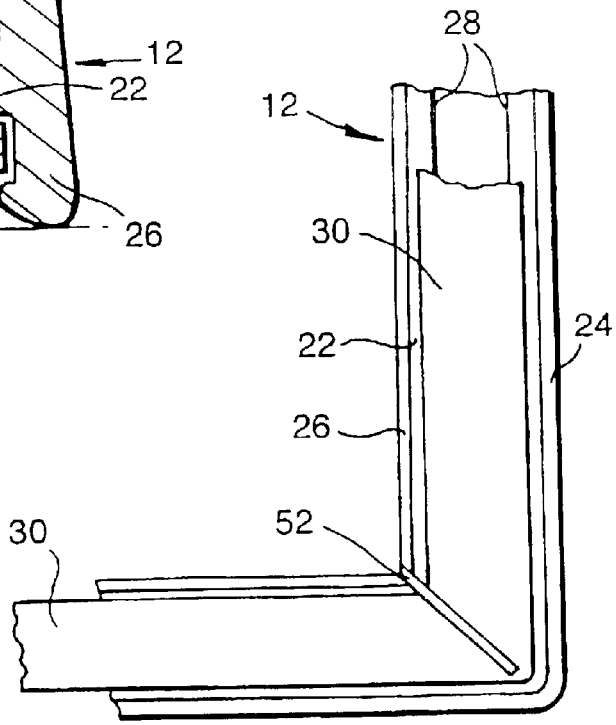
FIG. 4 is a plan view showing use of a method for effecting substantially sharp bends at the comers of the enclosure.

FIG. 4 shows use of a method for effecting substantially sharp bends at the corners of the enclosure.

An inner sector 26, including the lower of the upwardly extending arms 20 of unequal height of the first flexible profile element 12 is cut away at 52 near the corners to allow sharp bends.

In the figure the metallic strip element 30 in the lower channel 22 is also cut for the same purpose.

Seen in FIG. 5 is an illustration of the flexible channel filling member 48 m before assembly. The member is suitably made of an elastomer such as a soft PVC.

While in the embodiments illustrated in FIGS. 1-3 the upwardly extending arms 18 and 20, bounding upper channel 16 and the downwardly extending legs 24 and 26 bounding lower channel 22 also serve as the side walls and therefore channels 16 and 22 are vertically aligned, other configurations are also possible, as illustratively described with reference to FIGS. 6 and 8.

Figure 6:
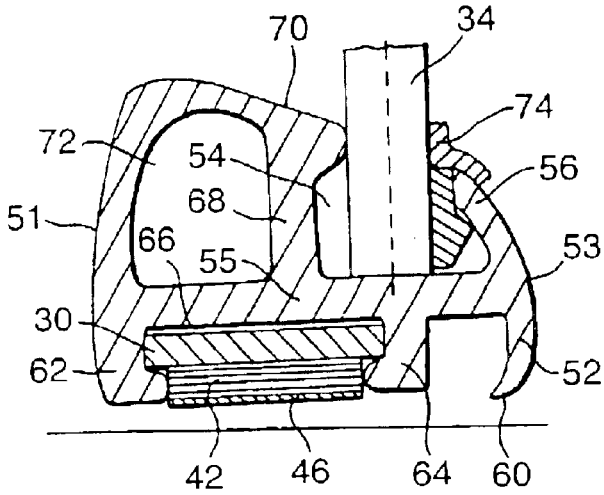
FIG. 6 is an end elevation of a further embodiment of a rigid composite base unit.

FIG. 6 shows a further embodiment of a rigid composite base unit, wherein side wall 51 is connected to side wall 53 by web 55, said web dividing said element into an upper channel and a lower channel, however wherein only the downwardly extending leg 62 of side wall 51 bounds the lower channel and only the upwardly extending arm 56 of side wall 53 bounds the upper channel, which upper and lower channels are vertically offset from each other.

Thus, as can be seen, the upper channel 54 in which the panel 34 is inserted is offset towards the lower 56 of two upwardly extending arms. This lower arm 56 has a downward extension 58 which carries a lower seal lip 60. The lip 60 extends down slightly below the lower surface of downwardly extending legs 62,64, so that when the metallic strip 30 disposed in the lower channel 66 is sealed to a floor surface 44, the lip 60 contacts the floor 44 and prevents water attacking the adhesive bond 46 between the metallic strip 30 and the floor surface.

As can be seen, in the present embodiment the upper portion of side wall 51 is spaced apart from upwardly extending arm 68 and connected thereto by an upper web surface 70 sloped down from the upper end of wall 51 across the top of the higher arm 68 towards the lower upwardly extending arm 56. A hollow space 72, saving material and improving flexibility, is thus formed between side wall 51, arm 68, web 55 and upper web 70, which hollow space 72 is located above the lower channel 66, which lower channel contains the metallic strip 30 described with reference to FIG. 1.

Figure 7:
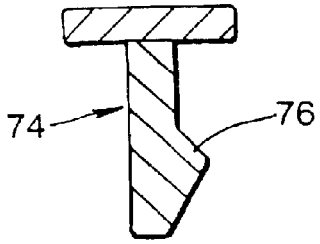
FIG. 7 is an end elevation of a flexible seal element used in the embodiment of FIG. 6.

The figure shows that the panel 34 has been sealed in the upper channel 54 by the insertion of a substantially T shaped element 74, further referred to in FIG. 7, between an inner surface of the panel 34 and an upwardly extending arm 56. Splash water thus drains off the panel 34, flows across the top of the T shaped element 74, over the lower arm 56 to enter a drain, not shown.

Seen in FIG. 7 is the flexible seal element 74 in its free state used in the embodiment of FIG. 6 . The element 74 is suitably made of an elastomer such as soft PVC or a butyl rubber. A lower wedge-like extension 76 prevents inadvertent release of the element from the profile.

Figure 8:
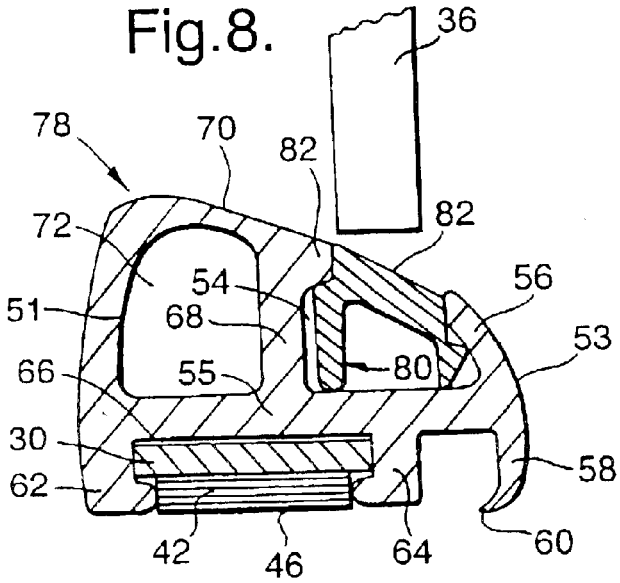
FIG. 8 is an end elevation of the flexible profile element of FIG. 6 as used under a door of a shower enclosure.

FIG. 8 displays the flexible profile element 78 described with reference to FIG. 6 as used under a door 36 of a shower enclosure.

A flexible channel filling member 80 is inserted along a segment of the upper channel 54 which prevents water entering the channel 54 and also stabilizes the profile. The filling member 80 has a cross-sectional shape which is substantially inverted U shaped with a sloping roof. The upper inclined surface 82 slopes away from a higher external upwardly extending arm 68 of the channel 54 to a lower internal upwardly extending arm 56 thereof. Thereby a water-proof seal is formed with the top 82 of the external upwardly extending arm 68.

The method for forming an enclosure comprises the following steps:

(a) Providing a first flexible profile element 12, as has been described with reference to FIG. 1.

b) Providing a metallic strip 30 of a length and configuration commensurate with at least a portion of the walls of the enclosure to be formed.

c) Inserting the metallic strip 30 into the lower channel 22 formed in the flexible profile element to form a rigid composite base element of a length and configuration commensurate with the enclosure panels and doors of the enclosure to be formed.

d) Inserting a plurality of enclosure panels 34 in the upper channel 16 between the inwardly directed interfacing portions 32 thereof to form the walls of the enclosure, said enclosure panels exerting vertical forces on said base unit to rigidify the same and creating a water-proof seal between said enclosure panels, said rigid composite base element and a smooth floor surface on which it is erected.

Figure 9:
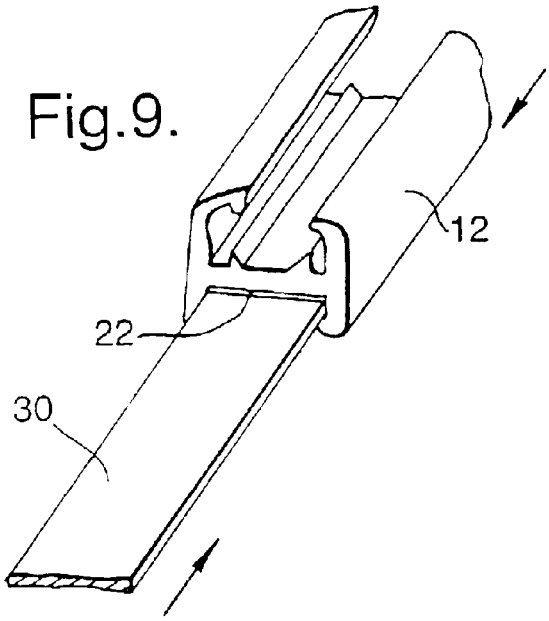
FIG. 9 is a perspective view illustrating an assembly method for the metallic strip.

Referring now to FIG. 9, there is illustrated the preferred method of assembling the metallic strip 30 with the flexible profile element 12 to form a rigid composite base element, as previously discussed. More specifically, the metallic strip 30, after being formed to its desired shape, e.g. with the use of computer-controlled laser cutting methods, is axially pushed into the lower channel 22 of flexible profile element 12. By doing so, profile element 12 loses much of its flexibility and turns into a rigid composite base element Such assembly would of course be impossible if both of these components were made of a rigid material. However, since the flexible profile element 12 is made of a soft material such as PVC, it readily conforms to the shape of the strip 30, which is typically made of aluminum or even steel.

Figure 10:
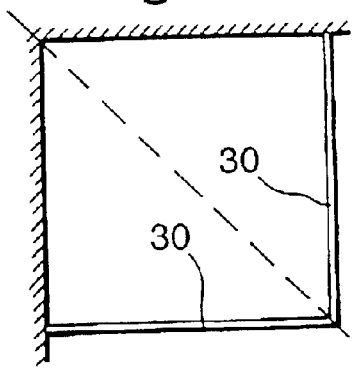
FIG. 10 is a plan view of a metallic strip arranged for a rectangular enclosure formed at an internal building corner.
Figure 11:
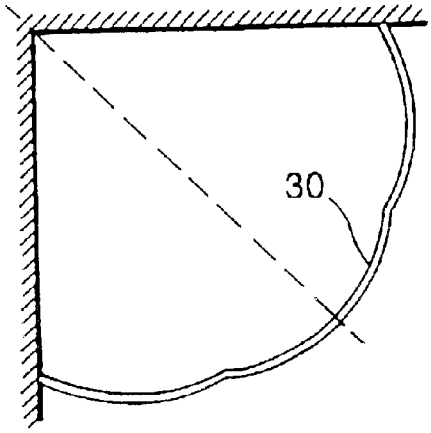
FIGS. 11 & 12 are plan views of enclosure bases wherein the metallic strip has been curved for producing curved enclosures.
Figure 12:
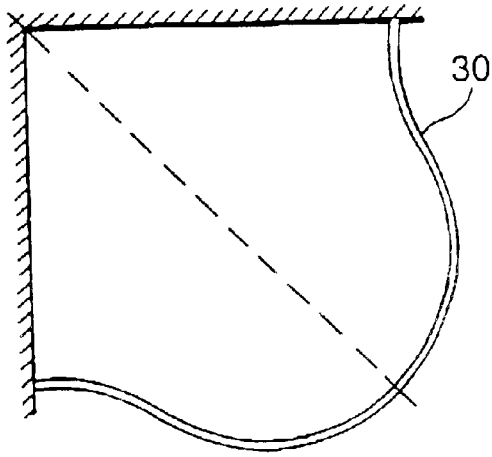

The special advantages of the base unit of the present invention can be appreciated when referring to appended FIGS. 10 through 12, and especially when noting the configurations shown in FIGS. 11 and 12.

FIG. 10 shows the metallic strip 30 forming two walls of a rectangular enclosure, the comer being formed in the manner described, with reference to FIG. 4.

Elegantly shaped enclosures have applications such as for use as changing rooms in shops selling clothing and for shower enclosures in the home and in hotels.

FIGS. 11 and 12 illustrate examples of such enclosures comprising three intersecting curves. The strip 30 is precut in arcuate shape and will impart this shape to the flexible profile element when inserted therein.

After assembly of the profile element 12 (not shown in these figures), to the strips 30 to form a rigid composite base element of the same curvature as the strip elements 30, the latter is attached to the floor, as described with reference to FIG. 2.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A method for forming an enclosure of the type having a plurality of enclosure panels and at least one door, comprising:

a) providing a first flexible profile element, said profile element having two side walls connected by an axially-extending web dividing said element into an upper channel bounded by a pair of spaced-apart, upwardly extending arms of unequal height, and a lower channel bounded by a pair of spaced-apart downwardly extending legs, each of said legs being provided with an inwardly directed flange for receiving and retaining at least one rigidifying second metallic strip element in said lower channel, said upper arms having inwardly directed interfacing portions for receiving and retaining an enclosure panel inserted therein;

b) providing a rigid metallic strip of a length and configuration commensurate with at least a portion of the walls of the enclosure to be formed;

c) inserting said rigid metallic strip into said lower channel formed in said flexible profile element to form a rigid composite base element of a length and configuration commensurate with the enclosure panels and doors of the enclosure to be formed, wherein said rigid metallic strips preconfigured to serve as a rigid template defining the shape of the flexible profile element when inserted therein and provides a rigidified perimeter base which serves as a template for the construction of the enclosure wall panels; and d) inserting a plurality of enclosure panels in said upper channel of said first profile element between said inwardly directed interfacing portions thereof to form the walls of said enclosure, while further rigidifying said first profile and creating a waterproof seal between said rigid composite base element and a smooth floor surface on which it is erected.

2. A method according to claim 1, furhter comprising inserting a wedge-like element between a surface of said panel and one of said upwardly extending arms.

3. A method according to claim 1, further comprising positioning a channel filling member along a segment of said upper channel, said member being provided with an upper inclined surface sloping away from a higher external upwardly extending arm of said channel to a lower internal upwardly extending arm of said channel, to form a waterproof seal with the top of said external upwardly extending arm segment.

4. A method according to claim 1, wherein said metallic strip is of a length and configuration commensurate with said base and said enclosure to be formed.

5. A method according to claim 1, wherein substantially sharp bends are effected at the comers of said enclosure, an inner sector including the lower of the upwardly extending arms of unequal height of said fist flexible profile element being cut away near said corners to allow said sharp bends.

6. A rigid composite base unit for use in the method of claim 1, said unit comprising:

a) a first flexible profile element, said profile element having two side walls connected by an axially extending web dividing said element into an upper channel bounded by a pair of spaced-apart, upwardly extending arms of unequal height, and a lower channel bounded by a pair of spaced-apart downwardly extending legs, each of said legs being provided with an inwardly directed flange for receiving and retaining at least one rigidifying second metallic strip element in said lower channel, said upper arms having inwardly directed interfacing portions for receiving and retaining an enclosure panel, inserted therein; and b) a rigidifying flat metallic strip of a length and configuration commensurate with at least a portion of the walls of the enclosure to be formed, the arrangement being such that upon insertion of said rigid metallic strip into said lower channel, there is formed a rigid composite base element of a length and configuration commensurate with the enclosure panels and doors of the enclosure to be formed, wherein said rigid metallic strip is preconfigured to serve as a rigidifing template defining the shape of the flexible profile element when inserted therein and provides a rigidified perimeter base which serves as a template for the construction of the enclosure wall panels.

7. A rigid composite base unit according to claim 6, wherein said upper and lower channels are vertically offset from each other and said upper channel is offset towards the lower of said upwardly extending arms, which lower arm carries a lower seal lip extending down slightly below the lower surface of said downwardly extending legs.

8. A rigid composite base unit according to claim 7, wherein the higher of said upwardly extending arms has an upper surface sloped down towards the lower of said upwardly extending arms, and includes a hollow space located above said lower channel.

9. A rigid composite base unit according to claim 6, wherein said metallic strip is provided on a lower face with a flexible seal element configured to contact the floor surface on which said base unit rests.

10. A rigid composite base unit according to claim 6, wherein said metallic strip is of a length and configuration commensurate with said base and said enclosure to be formed.

11. A rigid composite base unit according to claim 6, wherein said first flexible profile element is made of polyvinyl chloride (PVC).

12. A rigid composite base unit according to claim 6, wherein said first flexible profile element is made of polypropylene.

13. A rigid composite base unit according to claim 6, in combination with a plurality of enclosure panels inserted in said upper channel for exerting vertical forces on said base unit to rigidify the same and creating a water-proof seal between said enclosure panels, said rigid composite base element and a smooth floor surface on which it is erected.

* * * * *